US006029425A

United States Patent [19]

Dunn

[11] Patent Number: 6,029,425

[45] Date of Patent: Feb. 29, 2000

[54] BIN LOADER PACKAGE AND METHOD

[75] Inventor: George D. Dunn, Conway, Ark.

[73] Assignee: Union Camp Corporation

[21] Appl. No.: 09/042,210

[22] Filed: Mar. 13, 1998

Related U.S. Application Data

[60] Division of application No. 08/733,279, Oct. 17, 1996, Pat. No. 5,779,048, which is a continuation-in-part of application No. 08/597,949, Feb. 7, 1996, Pat. No. 5,779,049.

[51] Int. Cl.[7] ..... B65B 11/58; B65B 43/26

[52] U.S. Cl. ..... 53/449; 53/492; 271/145

[58] Field of Search ..... 271/145, 162; 206/449; 53/429, 449, 492

[56] References Cited

U.S. PATENT DOCUMENTS

| | | | |
|---|---|---|---|
| Re. 26,663 | 9/1969 | Dwyer, Jr. | 206/449 |
| 3,184,138 | 5/1965 | Ridgeway, Jr. . | |
| 3,631,972 | 1/1972 | Gendron . | |
| 3,750,932 | 8/1973 | Ellison . | |
| 3,799,406 | 3/1974 | Goerke . | |
| 3,820,686 | 6/1974 | Tyrseck . | |
| 3,870,222 | 3/1975 | Butler | 206/449 |
| 3,903,643 | 9/1975 | Blackmore et al. . | |
| 3,921,892 | 11/1975 | Macie . | |
| 4,210,273 | 7/1980 | Hegele . | |
| 4,397,406 | 8/1983 | Croley . | |
| 4,556,210 | 12/1985 | George . | |
| 4,570,796 | 2/1986 | Groom | 206/449 |
| 4,770,301 | 9/1988 | Nagel . | |
| 4,802,586 | 2/1989 | George | 206/449 |
| 4,830,186 | 5/1989 | George et al. | 206/449 |
| 4,858,414 | 8/1989 | Meschi . | |
| 4,964,511 | 10/1990 | Meschi . | |
| 5,064,113 | 11/1991 | Hauber et al. . | |
| 5,096,368 | 3/1992 | Butterfield | 206/449 |
| 5,251,819 | 10/1993 | McHugh . | |
| 5,261,595 | 11/1993 | Nanno et al. . | |
| 5,348,147 | 9/1994 | Gottfried . | |
| 5,779,049 | 6/1998 | Werby et al. | 206/449 |

*Primary Examiner*—John Sipos
*Attorney, Agent, or Firm*—Dennis H. Lambert

[57] ABSTRACT

A bin loader package and method for shipping, storing and dispensing cut paper directly into the paper supply bin of a machine which uses the paper. The package includes a box enclosure having opposite side walls, opposite end walls, a top wall and a bottom wall, enclosing a stack of paper sheets to be used in the machine. The enclosure is defined by telescopically interengaged tubular members which form the side and end walls, the top wall, and the bottom wall. The entire package is placed in the paper supply bin of the machine, and one of the members is then moved horizontally away from the other member and the stack of paper, after which the other member is lifted vertically away from the stack of paper and out of the paper supply bin to expose the paper and deposit it directly from the package into the paper supply bin.

2 Claims, 12 Drawing Sheets

FIG. 10
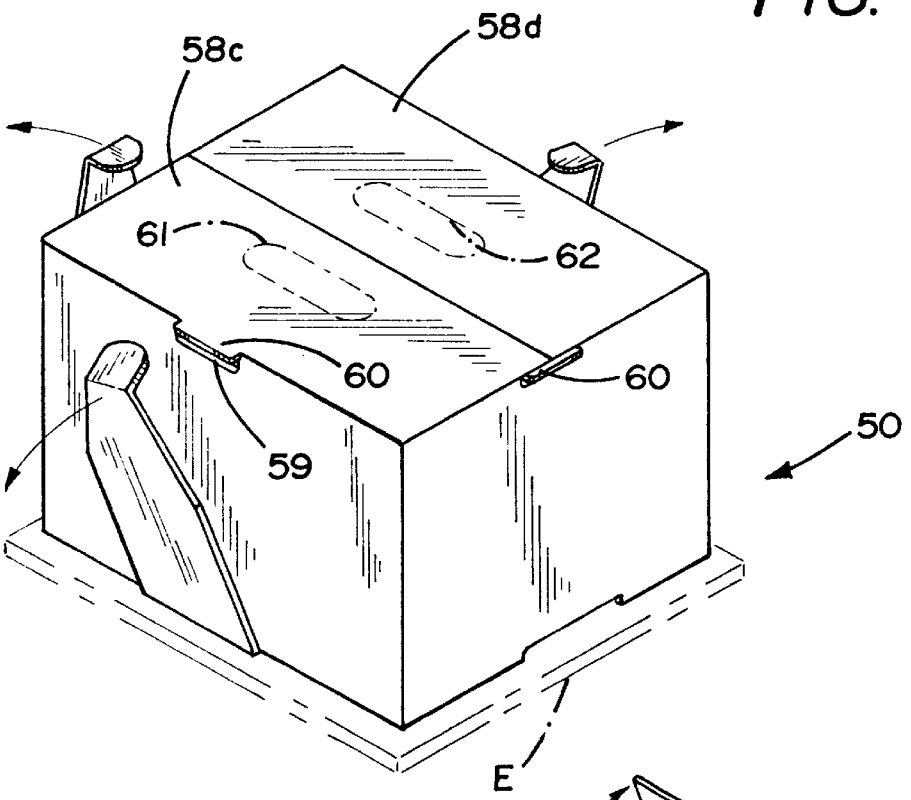
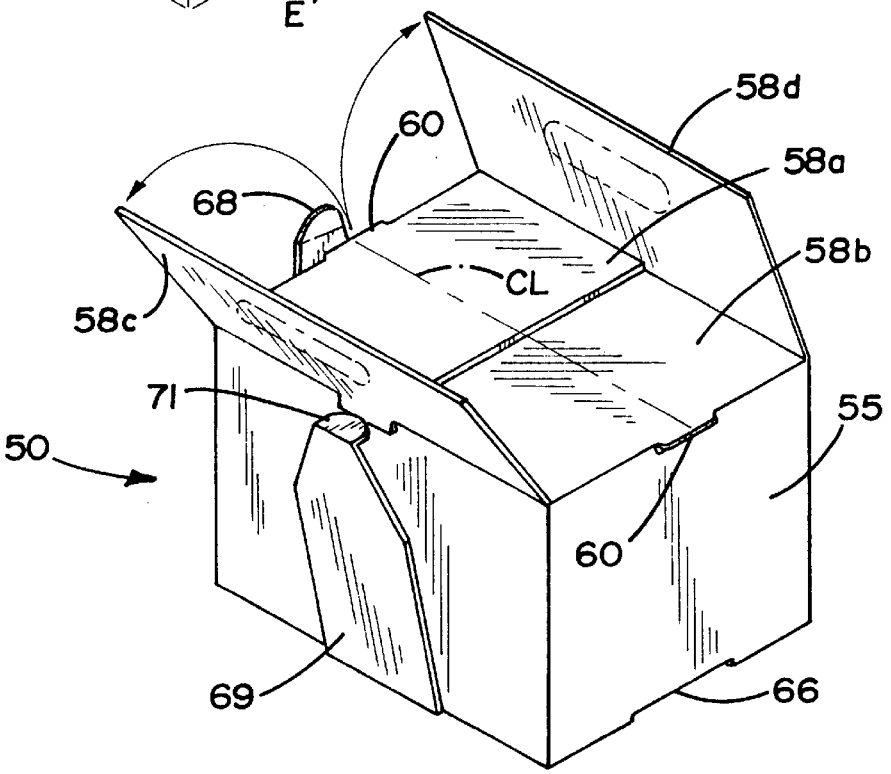
FIG. 11

BIN LOADER PACKAGE AND METHOD

RELATED APPLICATIONS

This application is a division of commonly owned application Ser. No. 08/733,279, filed Oct. 17, 1996, now U.S. Pat. No. 5,779,048 which is a continuation-in-part of commonly owned application Ser. No. 08/597,949, filed Feb. 7, 1996, now U.S. Pat. No. 5,779,049.

DESCRIPTION OF THE PRIOR ART

This invention relates to packaging, and more particularly, to a package and method for rapidly loading cut paper into the bin of a photocopier, printer, or similar machine. The invention is especially adapted for rapidly loading large quantities of cut paper into the paper supply bin of high-speed photocopying machines, printers, and the like, which typically use large quantities of paper over short periods of time.

BACKGROUND OF THE INVENTION

Photocopiers, printers and like equipment are in widespread use in commercial and office environments. Such equipment generally has a compartment or bin in which a stack of sheets of paper is placed for use by the machine during its operation.

The paper for use in such machines generally has been packaged in individual reams covered with a ream wrap material to assist in maintaining the proper condition of the paper, and the wrapped reams are then placed in a cardboard or similar box for shipment and storage. When the need arises for loading paper into a photocopier, printer, or the like, a box is opened and one or more reams of paper are removed from the box, the ream wrap removed, and the paper placed in the bin or other compartment of the machine for supplying paper to the machine during its operation.

This manner of packaging paper for use in such machines has not posed a problem for relatively low volume, low speed machines, since such machines typically hold only one or two reams or even less paper, and use it relatively slowly. However, relatively high speed, high volume photocopiers, printers and similar machines have come into more widespread usage, and these machines generally have relatively large paper holding capacities in order to provide an adequate supply of paper for the greater rate of use due to their higher speed of operation. In spite of the large paper holding capacity of such machines it may be necessary to frequently replenish the supply of paper in the bin. With conventional packaging, it can take considerable time to open the box and then remove and open individual reams of paper so that the paper can be stacked one ream at a time in the supply bin of the machine, which may typically hold five or more reams of paper.

Efforts have been made to solve this problem, as exemplified by U.S. Pat. Nos. 4,556,210, 4,770,301, 4,802,586 and 4,830,186. These patents disclose various packaging concepts for loading large quantities of paper into the supply bin of a photocopy machine without the necessity of opening individual reams of paper. In these patents, the receptacle for the paper either comprises a specialized device that is intended for use only at the location of the machine, or the carton or package of paper must be at least partially opended before it is placed on the elevator platform of the supply bin in the photocopier or other machine. The remaining part of the carton is then manipulated so that it can be removed from the bin, leaving the paper stacked on the platform. All of these patents (except U.S. Pat. No. 4,830,186) involve fairly complex and expensive constructions. The complexity of their construction increases the difficultly of use. Thus, while the prior art packages enable a large quantity of paper to be stacked in the supply bin of a photocopier or similar machine without requiring individual reams of paper to be opened, the prior art devices are relatively complex and expensive in construction, and/or relatively cumbersome to use, thereby at least partially offsetting the advantages gained by eliminating the need to open and handle individual reams of paper.

Several variations of bin loader package offering solutions to the shortcomings of prior art packages are proposed in co-pending application Ser. No. 08/597,949, commonly owned with this application. The present application is directed to further improved bin loader packages which overcome the shortcomings of prior art packages. The present invention thus fulfills the need for a simple and inexpensive package which enables a large quantity of paper to be quickly and easily supplied to the paper supply bin of a photocopier or printer or other machine, without the necessity of separately handling individual reams of paper.

SUMMARY OF THE INVENTION

The present invention provides an exceptionally simple and economical package for shipping, storing and dispensing paper into the paper supply bin of photocopiers, printers, and similar equipment.

The basic concept of the invention is to provide a single stack of loose sheets of paper in a box sized roughly for the capacity of the supply bin of a photocopier, printer, or similar machine. The box is configured to securely confine and protect the loose sheets of paper during shipping, storage and handling, and may be lifted and placed intact on the elevator platform of the paper supply bin of the photocopier or other machine, with the paper held securely in the box, and the box then removed to deposit the paper onto the elevator platform of the paper supply bin. The box includes multiple, interengaged components that may be easily separated from one another while the box and paper held therein are supported on the elevator platform of the paper supply bin, with at least one of the components of the box being removable from the supply bin to leave the stack of loose sheets of paper in place on the elevator platform, ready for use by the machine.

More specifically, the box is defined by first and second members interengaged with one another to form opposite side and end walls, a top wall and a bottom wall. The first member forms at least the bottom wall, and the second member forms at least one of the side and end walls.

In one form of the invention, the box comprises first and second telescopically interengaged tubular sleeve members having open ends, with the second member telescopically engaged inside the first member so that the walls of each sleeve close the open ends of the other sleeve, thereby completely enclosing the loose sheets of paper held therein. The inner sleeve is disposed with its open ends oriented along a vertical axis so that its side walls closely encircle and encompass the side edges of the stack of loose sheets of paper, with the open top and bottom ends of the sleeve disposed at the top and bottom, respectively, of the stack of paper. The outer sleeve is disposed with its oriented along a horizontal axis and open ends disposed at opposite ends of the box. The walls of the outer sleeve encircle the top, bottom and opposite sides of the inner sleeve, closing the open top and bottom of the inner sleeve. Similarly, the opposite end walls of the inner sleeve close the opposite open ends of the outer sleeve.

Handle means are provided on the outer sleeve for lifting the package and depositing it into the supply bin of a photocopier or the like. Further handle means are on an end flap of the outer sleeve so that the further handle means may be grasped through an open side of the supply bin to pull the outer sleeve away from the inner sleeve and stack of paper held therein, leaving the outer sleeve and stack of paper in position on the elevator platform of the paper supply bin. Thereafter, the outer sleeve may be grasped and lifted upwardly through the top of the paper supply bin, depositing the stack of loose sheets of paper on the elevator platform of the supply bin and ready for use by the machine.

This form of the invention is very simply and economically constructed from two elongate flat blanks which may be folded about transverse fold lines to form the open-ended tubular structures. Juxtaposed ends of the folded blanks are secured together by a manufacturer's glue seam.

A second form of package according to the invention comprises first and second interengaged members forming an enclosure to surround and protect the paper during storage and handling. The first member comprises a bottom panel having elongate flaps on one end and two opposite sides, and the second member comprises a box-like structure having side and end walls, foldable panels defining a closable lid, and an open bottom. The bottom panel extends across and closes the open bottom of the second member and the plurality of elongate panels or flaps extend upwardly from their respective side edges of the bottom panel and along the outside of one end wall and two adjacent side walls of the second member, with tabs at the upper ends of the flaps extending into slots at the top edges of the two side walls and one end wall of the second member to support and hold the bottom panel in place. When the two members are thus joined together, the bottom panel is supported in position to close the open bottom of the second member, defining a complete box structure. The box and the stack of loose sheets of paper enclosed therein can be lifted onto the elevator platform of the paper supply bin of a photocopier or the like, and the tabs removed from the slots to release the elongate flaps, whereby the second member may be lifted upwardly away from the stack of paper, depositing the stack of paper and the first member onto the elevator platform of the paper supply bin. The first member may be left in place in the paper supply bin if desired. In this regard, it should be noted that the elongate flap is omitted from one end of the bottom panel and a corresponding end of the box structure, whereby the machine can retrieve paper from that end of the stack of paper without being impeded by the presence of the first member in the paper supply bin.

The box in either from of the invention may be shrink-wrapped to protect the paper held therein from the environment, and one or more tie straps may encircle the package, if desired. The tie strap and shrink wrap are preferably removed before the box and paper are deposited into the paper supply bin of a photocopier or the like.

The box components may also be treated with a moisture vapor barrier material, or other means may be provided to maintain proper moisture content in the paper stored within the box.

The first and second members in both forms of the invention are each easily and economically made from single blanks of folded material such as cardboard, and do not require separate fasteners, tear strips, or the like in their construction and use. Consequently, the box enclosure formed thereby can be easily disassembled in situ in a paper supply bin to release the paper and deposit it directly onto the elevator platform of the supply bin, and one or both of the members, as necessary, may be easily removed from the bin prior to operation of the machine.

In all forms of the invention, dispensing of the paper into the supply bin of a photocopier or other machine is easily accomplished simply by lifting the package into the supply bin, releasing one component of the box from the other, and then removing at least one component of the carton or box from the bin, depositing the paper onto the platform of the bin in position for use by the machine.

The box of the invention may be made of any suitable material, including cardboard, paperboard, plastic, or other material, as desired. Moreover, the package of the invention may be made in any desirable size for holding an appropriate quantity of paper to fill the bin capacities on various photocopiers, printers and other machines that may be used. It is contemplated, however, that the paper capacity of the package according to the invention will range from about 1,500 sheets up to about 2,500 sheets.

BRIEF DESCRIPTION OF THE DRAWINGS

The foregoing, as well as other objects and advantages of the invention, will become apparent from the following detailed description when considered in conjunction with the accompanying drawings, wherein like reference characters designate like parts throughout the several views, and wherein:

FIG. 9 is a top perspective view of the package of FIG. 8, with the shrink wrap and tie strap removed, and showing the package resting on the elevator platform in the paper supply bin of a photocopier or the like;

FIG. 10 is a top perspective view of the package of FIG. 9, showing the tabs removed from the slots at the top edges of the package, releasing the elongate support flaps;

FIG. 11 is a top perspective view of the package of FIG. 10, showing the two lid side panels in opened position;

DETAILED DESCRIPTION OF THE PREFERRED EMBODIMENTS

Figure 1:
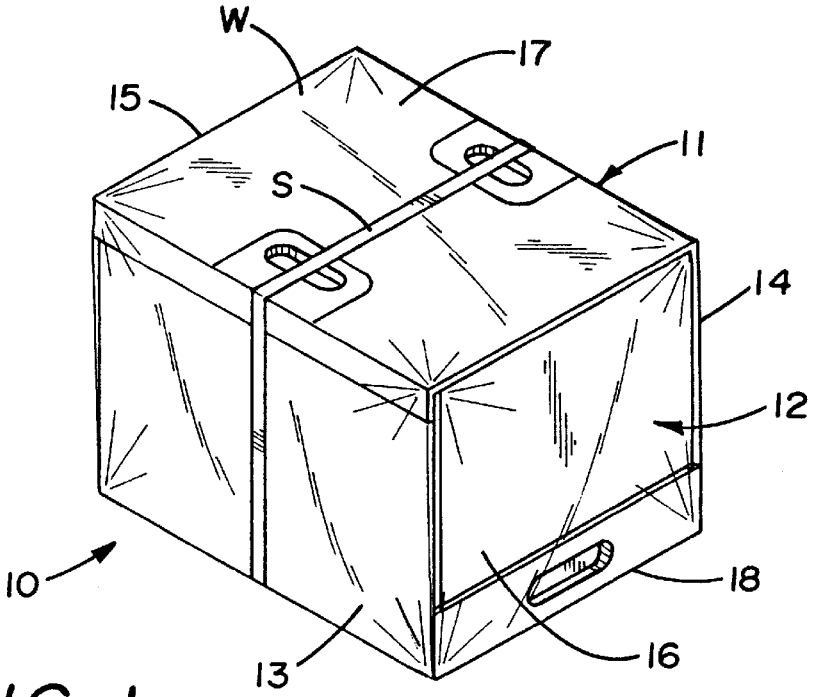
FIG. 1 is a top perspective view of a first form of the bin loader package according to the invention, wherein the package is shrink-wrapped and has a tie strap applied to it.

Referring more specifically to the drawings, a first form of bin loader package according to the invention is indicated generally at 10 in FIGS. 1–7. The package according to this form of the invention is formed by first and second rectangularly-shaped, open-ended tubular members 11 and 12, respectively, telescopically interengaged with one another with the open ends of each member closed by the walls of the other member to form a rectangular box enclosure having opposite side walls 13 and 14, opposite end walls 15 and 16, a top wall 17 and a bottom wall 18. As depicted in FIG. 1, the box may be surrounded by a shrink wrap W and may have one or more tie straps S encircling it. The shrink wrap and tie strap may be omitted if desired, although they afford extra protection to the paper stored within the box, lend integrity to the package, and facilitate handling of it.

With particulars reference to FIGS. 2–7, the first, outer tubular sleeve member 11 has a plurality of cuts 20 and 21 formed in the top wall 17 adjacent opposite sides thereof, defining a pair of foldable handles 22 and 23 at opposite sides of the box, each of which has a cut-out 24 therein defining a hand grip or handle which may be used to lift the package. Small areas of the cuts 20 and 21 may be interrupted to define small webs 25 joining the handles 22 and 23 to the lid or top wall 17 so that the handles 22 and 23 will remain in flat, folded position coplanar with the lid or top wall 17 until it is desired to use them. See FIG. 7.

Further, a narrow panel or flap 26 is formed on one end of the bottom wall 18 of outer sleeve member 11, and this flap 16 is normally folded upwardly into parallel, contiguous relationship with end wall 16 of the second, inner sleeve member 12. A cut-out 27 is formed in the flap 26 to form a hand grip or handle which may be used to facilitate separation of the inner and outer sleeve members, when desired, as explained more fully hereinafter.

Figure 2:
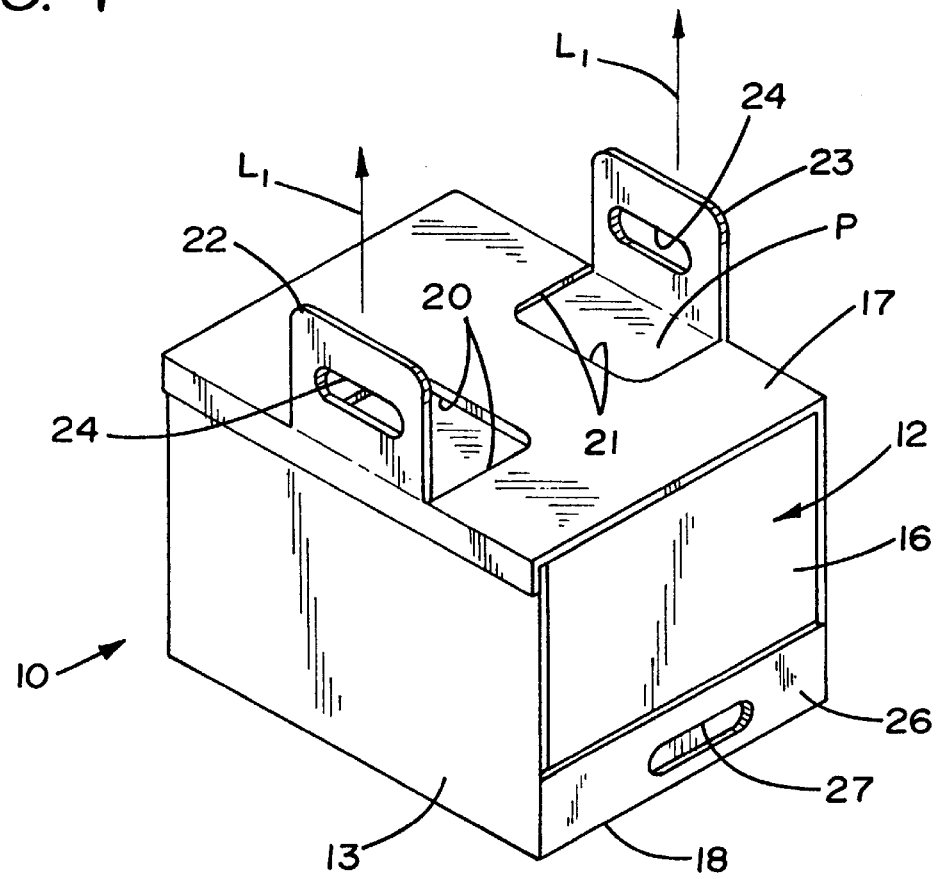
FIG. 2 is a top perspective view of the package of FIG. 1, with the shrink wrap and tie strap removed, and demonstrating how the handles on the outer sleeve member may be grasped to lift the package.
Figure 3:
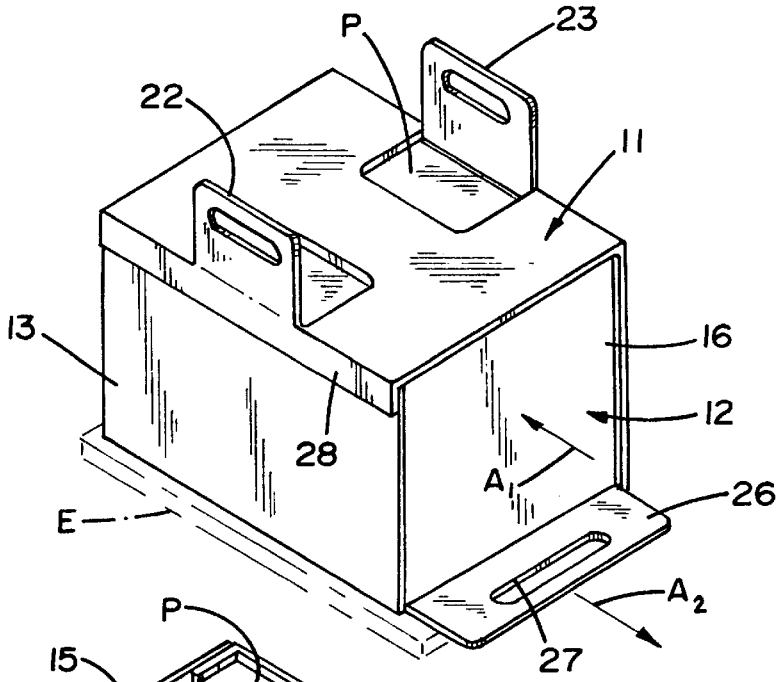
FIG. 3 is a top perspective view of the package of FIG. 2, showing the package in place on the elevator platform of the paper supply bin of a photocopier or the like, and depicting how the inner and outer sleeve members may be engaged to be moved relative to one another.
Figure 7:
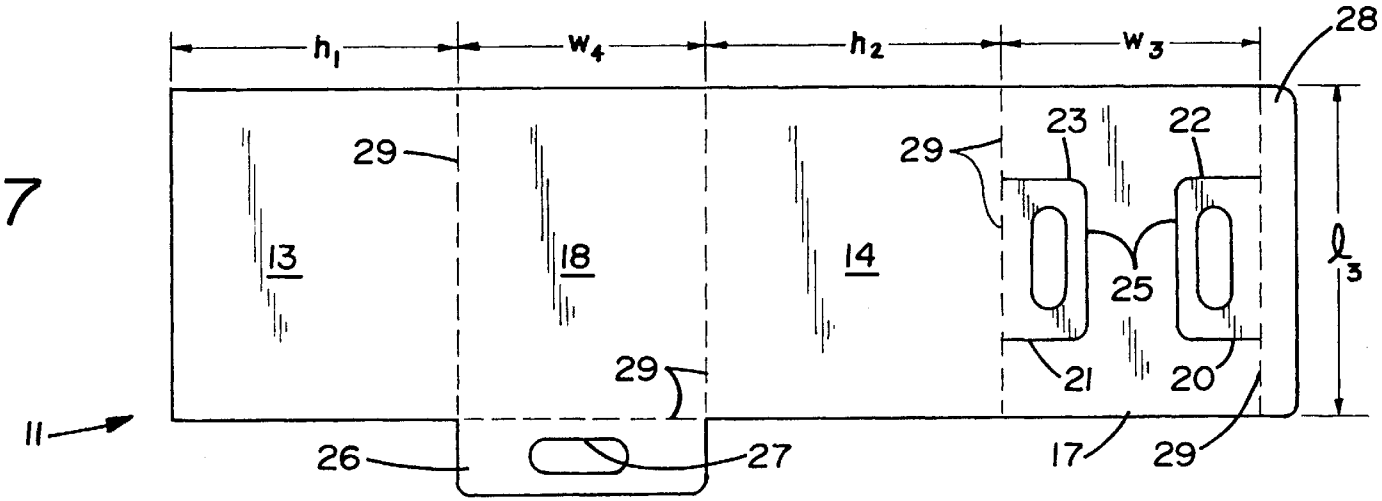
FIG. 7 is a top plan view of the blank used to form the outer sleeve member.
Figure 8:
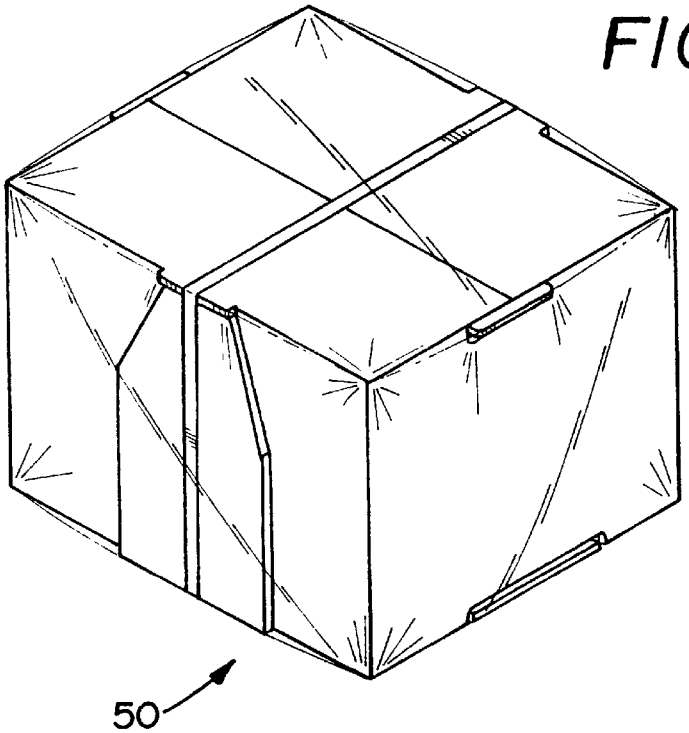
FIG. 8 is a top perspective view of a second form of bin loader package according to the invention, wherein the package is shrink-wrapped and has a tie strap applied to it.
Figure 9:
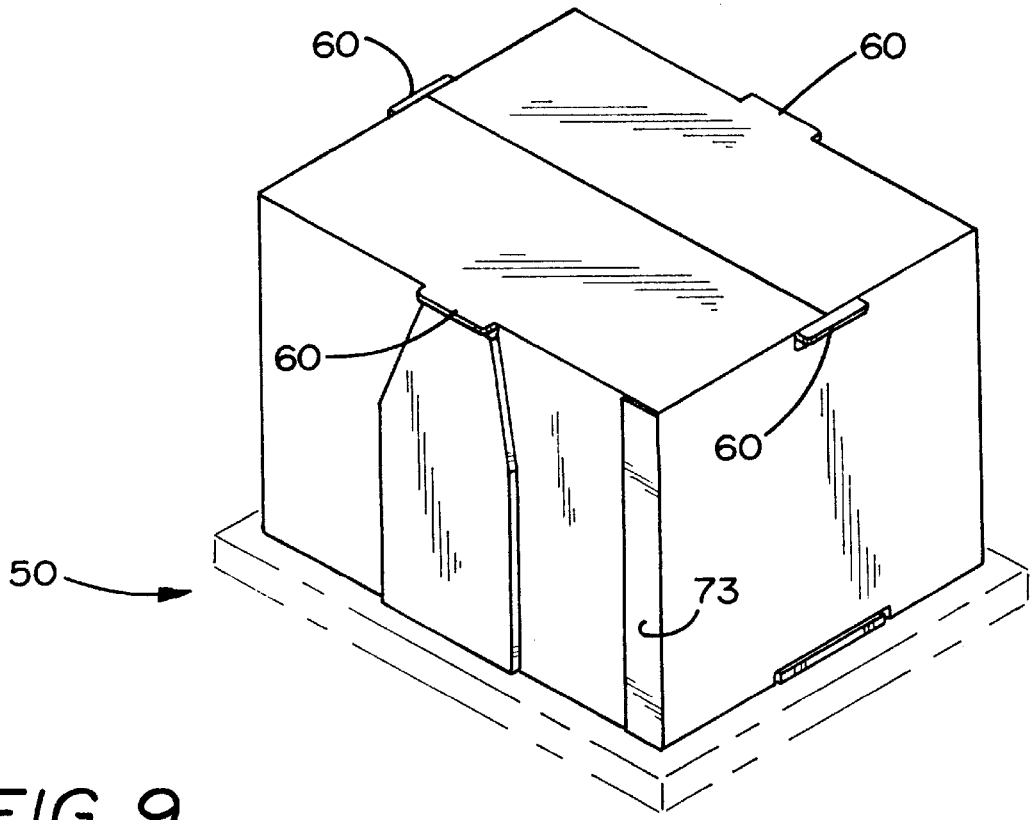

As seen in FIGS. 2 and 7, a glue tab 28 is formed along one side edge of top wall panel 17 of the outer sleeve member 11, and when the blank forming sleeve member 11 is folded about fold lines 29 to erect the sleeve member, this glue tab is adhesively secured along a top edge of side wall 13 of the outer sleeve member 11, forming a manufacturer's glue seam to hold the outer sleeve member in erected relationship.

Figure 4:
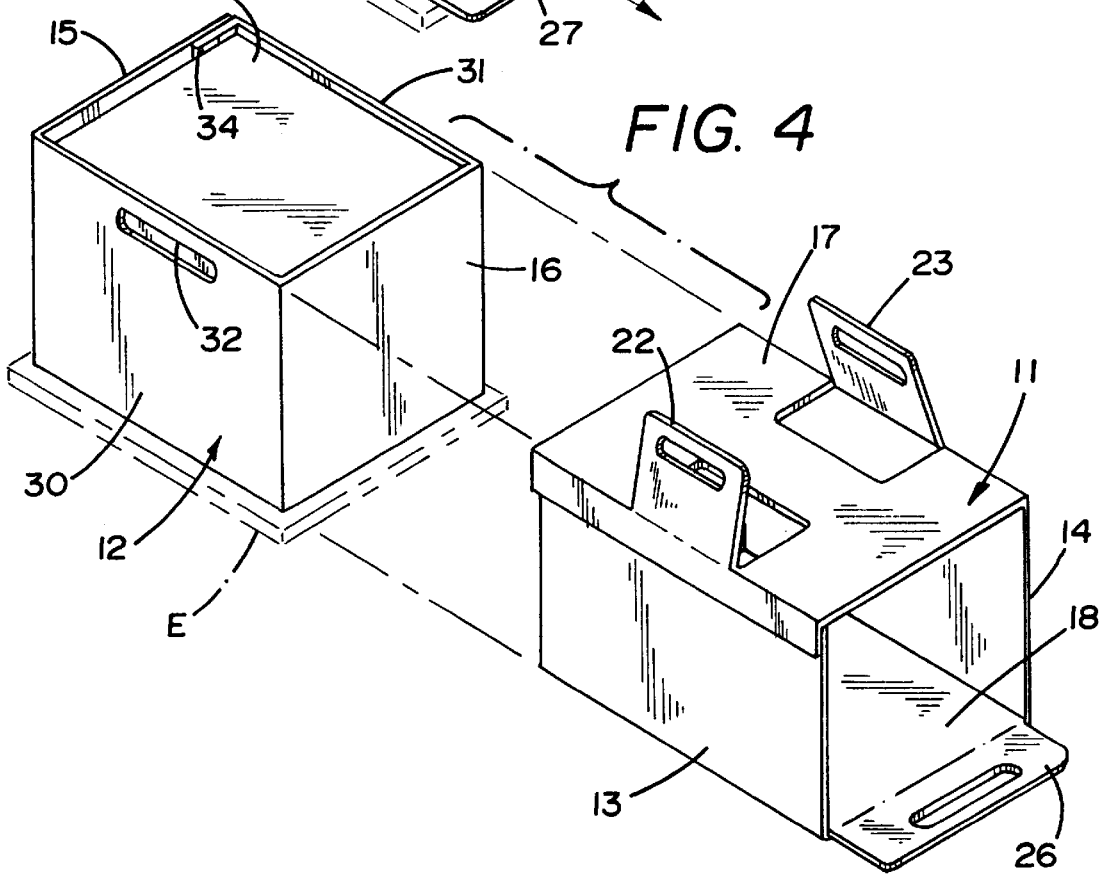
FIG. 4 is an exploded top perspective view of the package of FIG. 3, showing the outer sleeve member removed from the inner sleeve, depositing the inner sleeve and the paper confined therein on the elevator platform.
Figure 5:
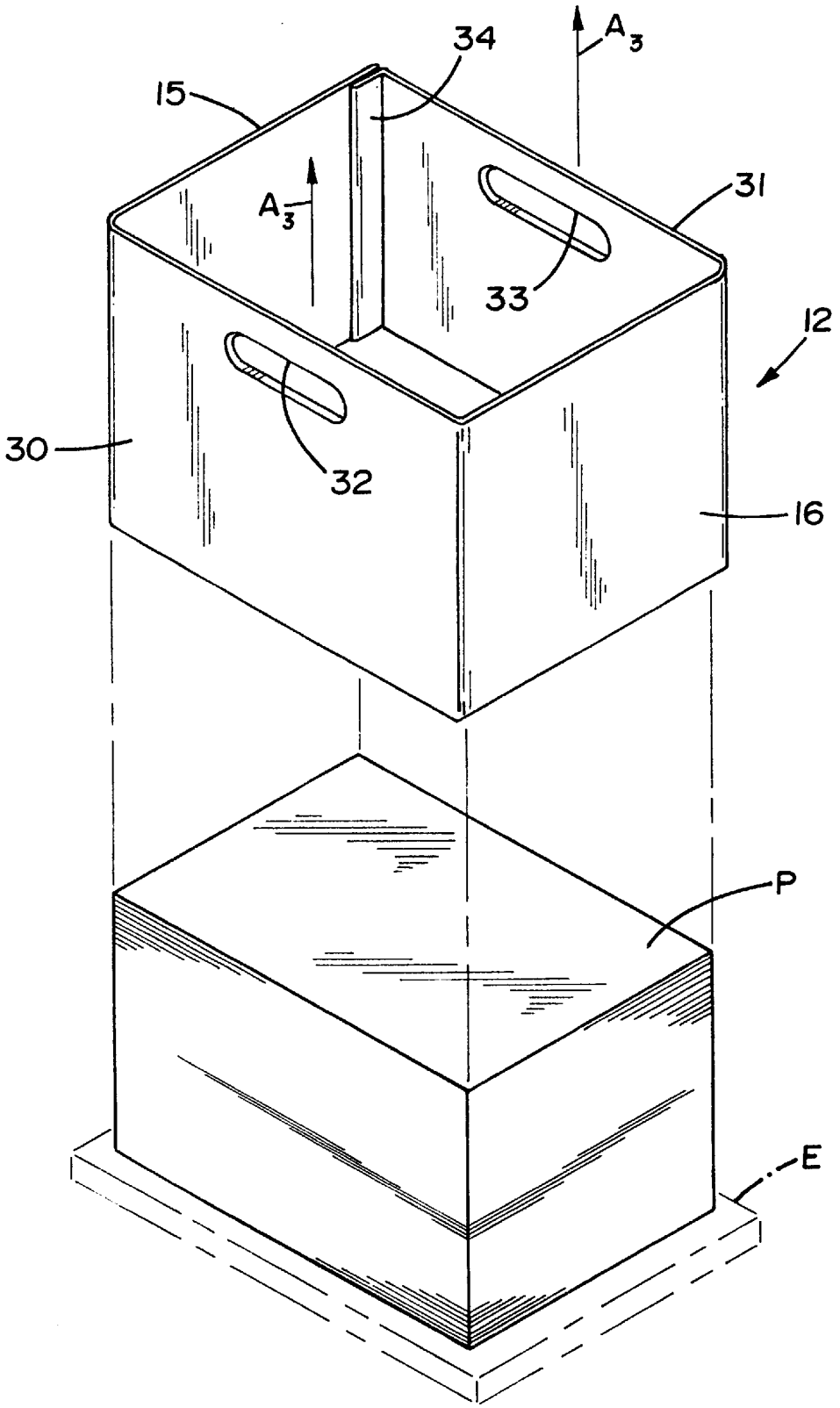
FIG. 5 is an exploded top perspective view depicting how the outer sleeve member may be lifted away from the stack of paper, depositing it onto the elevator platform.
Figure 6:
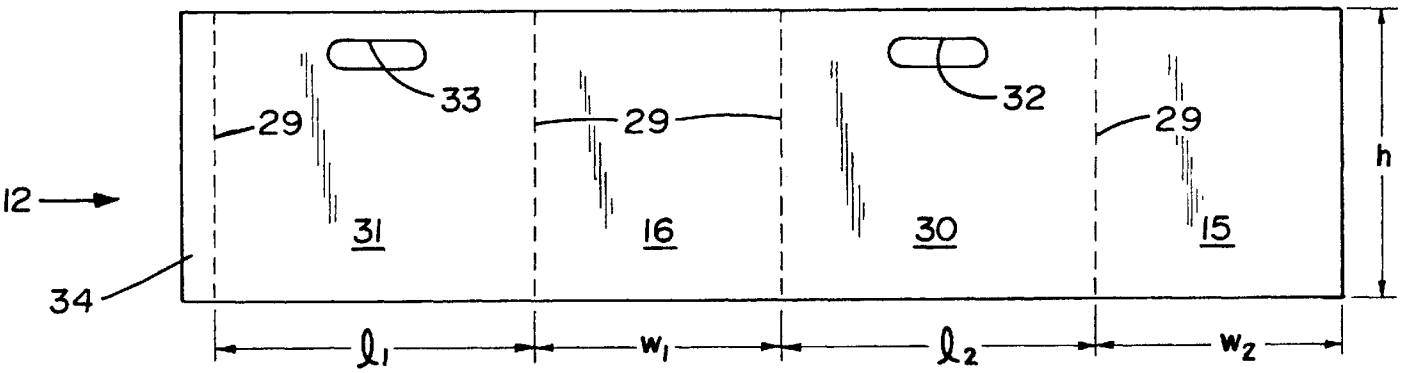
FIG. 6 is a top plan view of the blank used to form the inner sleeve member.

With particular reference to FIGS. 4 and 6, the second, inner sleeve member 12 includes the opposite end walls 15 and 16, and opposite side walls 30 and 31. Elongate openings 32 and 33 are formed in the side walls 30 and 31, respectively, adjacent their upper edges to facilitate lifting of the inner sleeve member 12 away from the stack of paper P, as shown in FIG. 5. A glue tab 34 is formed along one end edge of side wall panel 31, and when the blank forming sleeve member 12 is folded about fold lines 29 to erect the sleeve member, this glue tab is adhesively secured along an adjacent edge of end wall panel 15, forming a manufacturer's glue seam to hold the inner sleeve member in erected relationship.

In a specific example of a bin loader package according to this form of the invention, the end walls 15 and 16 and opposite side walls 30 and 31 of the inner sleeve member 12 have a height h of about 10.04 inches. Side wall 31 has a length $l_1$ of about 11.07 inches and side wall 30 has a length $l_2$ of about 11.05 inches (the difference in length accommodating the thickness of the wall at the glue joint). Similarly, end wall 16 has a width $w_1$ of about 8.13 inches, while end wall 15 has a width $w_2$ of about 8.12 inches.

Side walls 13 and 14 in outer tubular sleeve member 11 have heights $h_1$ and $h_2$, respectively, of about 10.04 inches and about 10.07 inches, and a length $l_3$ of about 11.10 inches. Top wall 17 and bottom wall 18 have widths $w_3$ and $w_4$, respectively, of about 9.00 inches and about 9.02 inches.

These package dimensions are obviously for use in packaging letter size paper, and it should be understood that other dimensions could be utilized in the package, depending upon the size of the sheets of paper to be packages therein.

The manner of use this form of bin loader package is believed apparent from the foregoing description. As previously indicated, the package may be shrink-wrapped and have a tie strap S applied to it to protect the paper from the environment during storage and handling and also to facilitate handling of the package. When it is desired to use the paper in the package, the strap S and shrink-wrap W are removed and the handles 22 and 23 may be raised as indicated in FIG. 2 and used to lift the package as indicated by the arrows $L_1$ to place the package on the elevator platform of the paper supply bin of a photocopier or other machine. The user may then engage end wall 16 as indicated by arrow $A_1$ in FIG. 3 and use the other hand to pull handle 26 as indicated by the arrow $A_2$ to pull the outer sleeve member 11 away from the inner sleeve member 12 and stack of paper P, as illustrated in FIG. 4, depositing the stack of paper P and the inner sleeve member 12 on the elevator platform E.

Inner sleeve member 12 may then be grasped by inserting the fingers into the openings 32 and 33, for example, as indicated by arrows $A_3$ to lift the inner sleeve member away from the stack of paper P, depositing the paper unencumbered on the elevator platform E as seen in FIG. 5.

A second form of bin loader package according to the invention is indicated generally at 50 in FIGS. 8–19. This form of the invention includes first and second members 51 and 52, respectively, that are releasably interconnected to form a box-like enclosure for containing the stack of paper P.

The second member 52 is a box-like structure, having opposite side walls 53 and 54, opposite end walls 55 and 56, an open bottom 57, and a plurality of closure flaps 58*a*–58*d* forming a lid. With particular reference to FIGS. 11–14, it can be seen that the closure flaps include opposite end flaps 58*a* and 58*b* and opposite side flaps 58*c* and 58*d*. When the end flaps 58*a* and 58*b* are folded inwardly over the open top of the box, they extend beyond the transverse mid-plane of the box to lines $L_1$ and $L_2$, respectively, whereby the adjacent ends of the inwardly folded flaps lie in overlapping relationship to one another. See FIGS. 11, 12 and 14. The opposite side flaps 58*c* and 58*d*, on the other hand, extend inwardly only to the longitudinal center line of the box as indicated by the dot-and-dash line CL, whereby the opposite side flaps do not overlap one another while folded to their closed position, but merely extend into edge-to-edge relationship with one another. See FIGS. 11 and 14. Additionally, a wide, shallow, U-shaped cut 59 is made in each side and end wall adjacent the top edge thereof, extending downwardly into the respective wall from the fold line defining the respective closure flap 58*a*–58*d*. These cuts result in the formation of a small tab 60 on each closure flap, which, when the flaps are folded to their closed position, extend horizontally, defining narrow slots or openings at the top edge of each side and end wall intermediate their ends. If desired, a pair of elongate openings or cut-outs 61 and 62 may be formed in the closure flaps 58*c* and 58*d*, respectively, as indicated by dot-and-dash lines in FIGS. 10, 11 and 13, to serve as hand grip openings such as 32 and 33 described in connection with the first form of the invention.

Additionally, a relatively wide, shallow, inverted U-shaped opening or cut-out 63 is formed intermediate the length of the bottom edge of each of the side and end walls 53–56, in substantially vertical alignment with the cut-outs 59 at the top edges of the walls, but of greater width than the openings 59.

Figure 13:
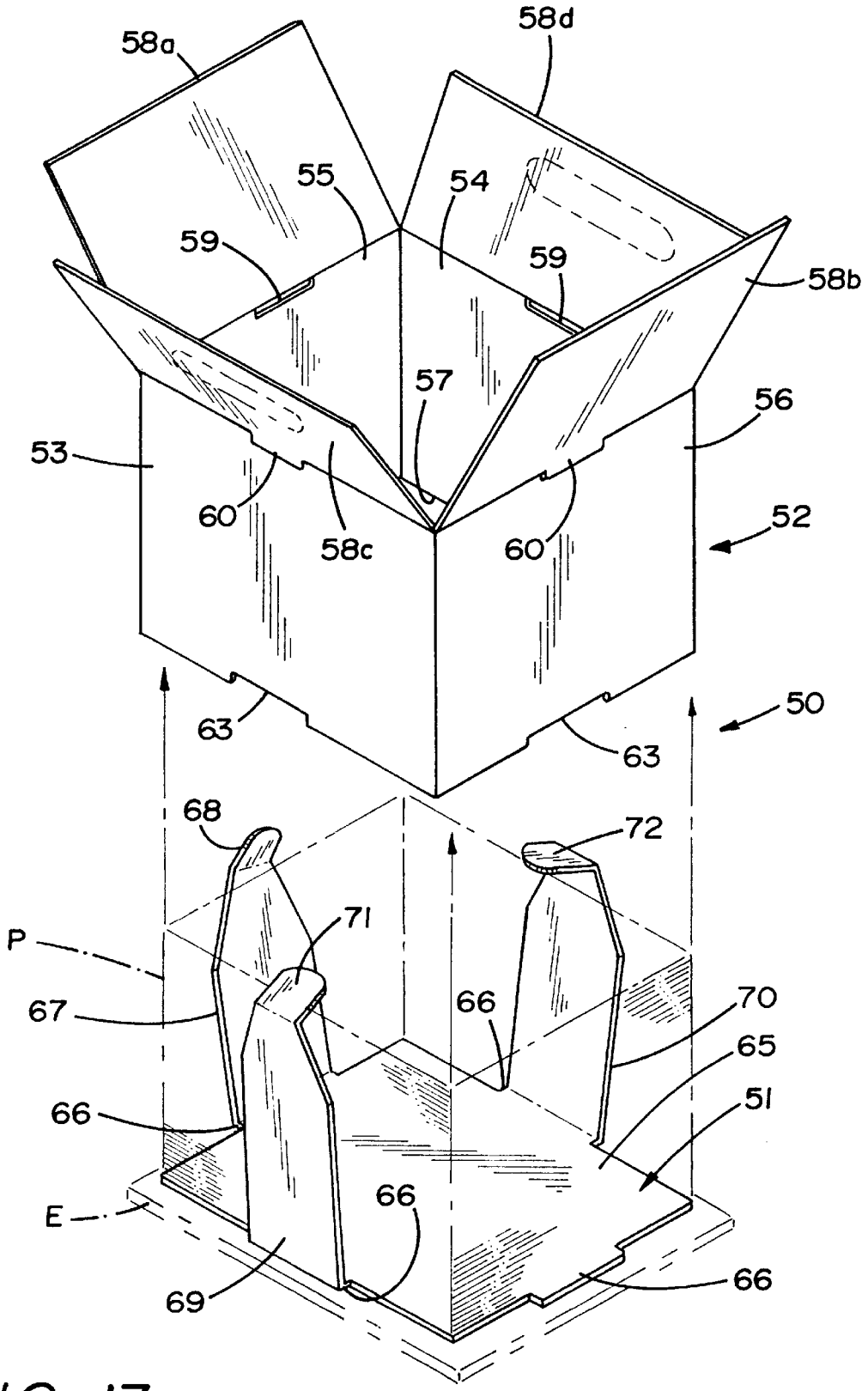
FIG. 13 is an exploded top perspective view of the package of FIG. 9, showing the open-bottomed first package component or member being lifted away from the stack of loose sheets of paper, to deposit the paper and the bottom panel member and its associated support flaps on the elevator platform of the photocopier or other machine.
Figure 14:
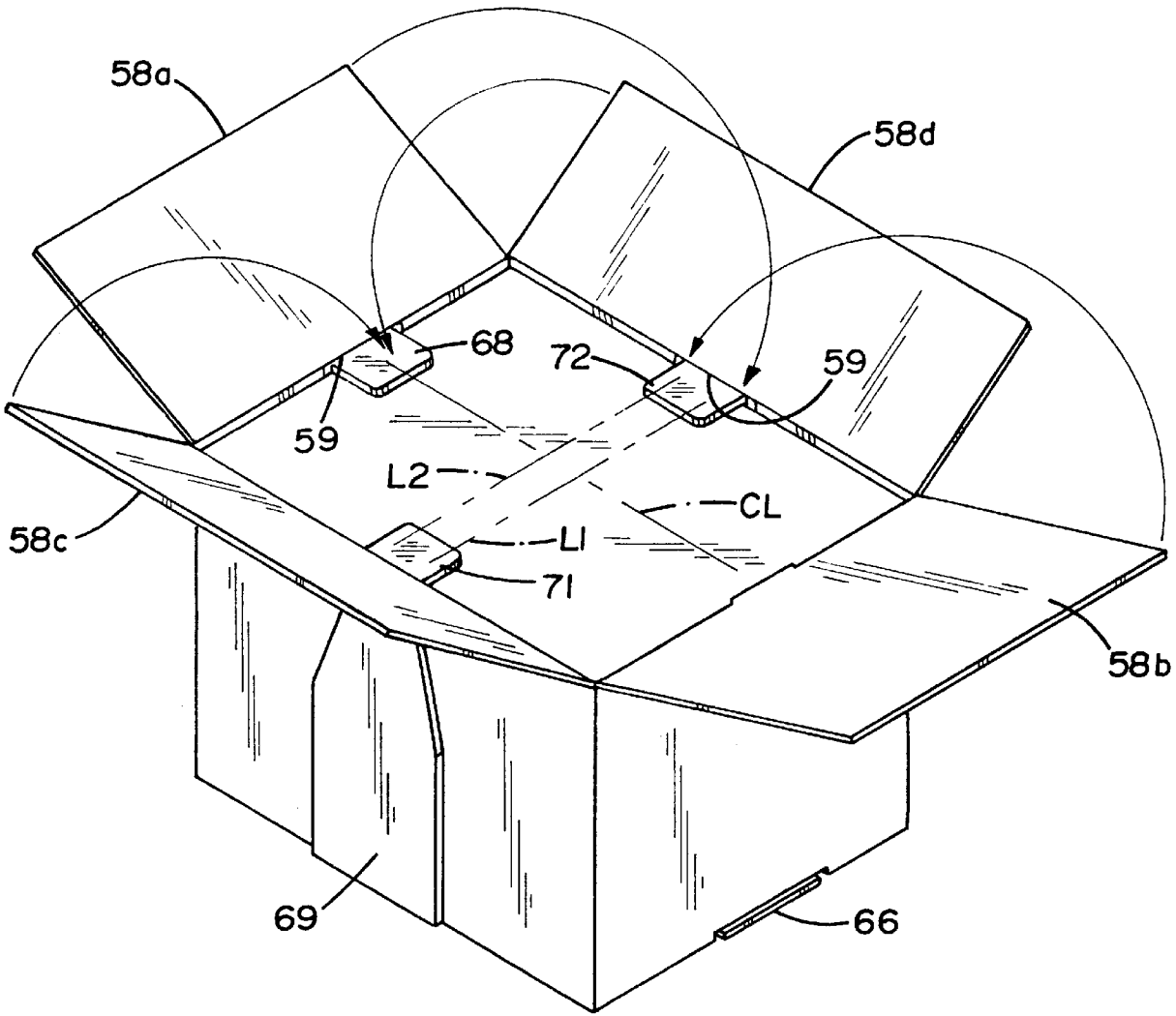
FIG. 14 is a top perspective view of the package of FIG. 9, showing the lid panels in opened position to illustrate how the tabs on the elongate support flaps extend inwardly over the stack of sheets of paper, and illustrating in dot-and-dash lines the relationship of the lid panels when they are closed position.
Figure 15:
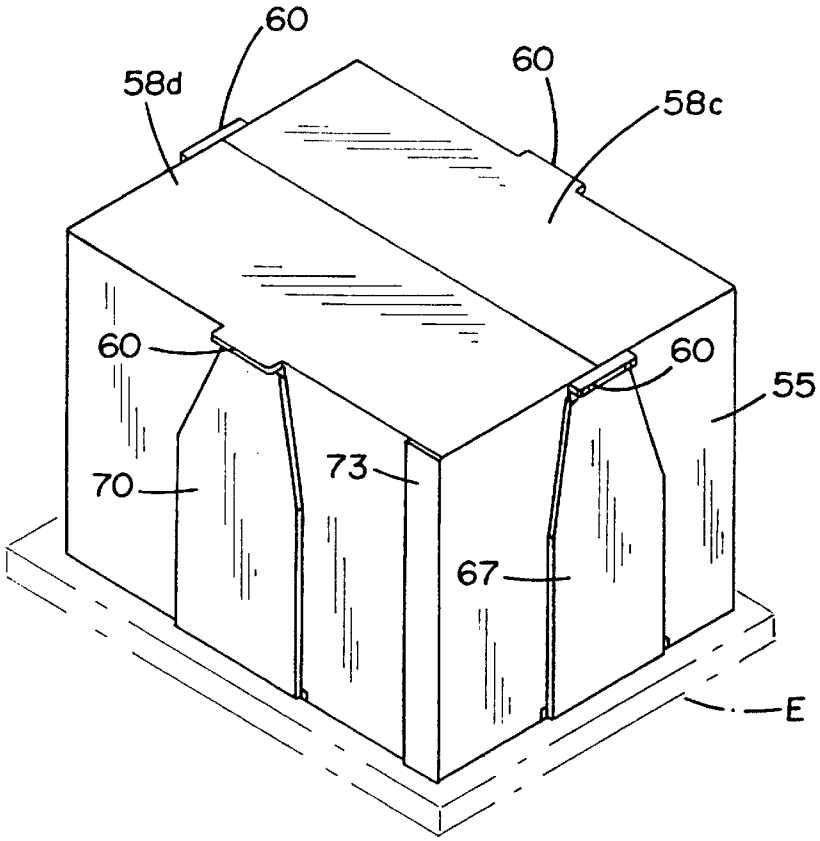
FIG. 15 is a top perspective view of the package of FIG. 9, taken from the opposite end shown in FIG. 9 to illustrate the elongate flap that extends upwardly along that end of the package.
Figure 16:
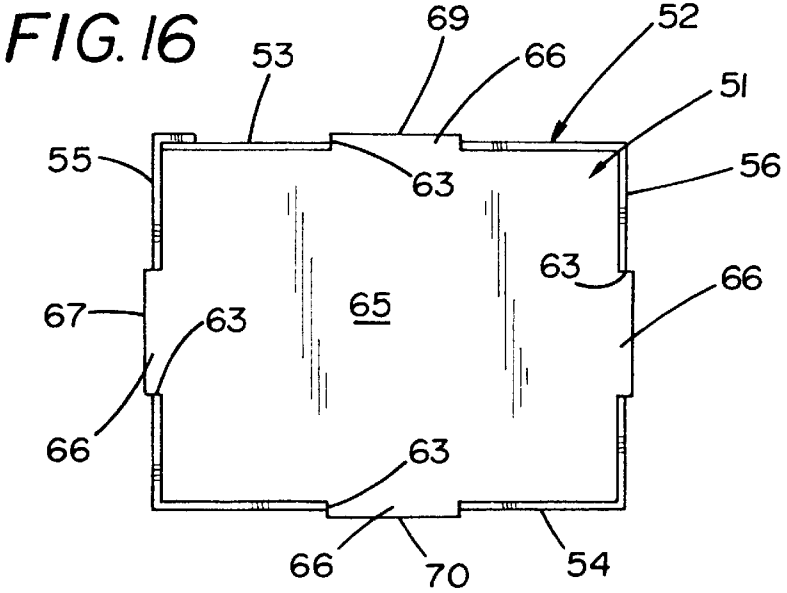
FIG. 16 is a bottom plan view of the package of FIG. 9.
Figure 17:
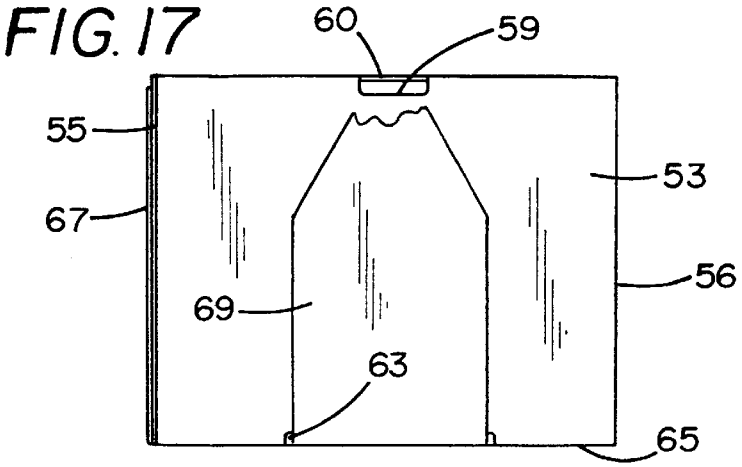
FIG. 17 is a side view in elevation, with portions broken away, of the package of FIG. 9.

As seen best in FIG. 13, the first member 51 comprises a flat, rectangularly-shaped bottom panel 65 shaped and sized to fit closely within the open bottom 57 of second member 52.

Relatively short stubs 66 project outwardly from each of the side and end edges of the bottom panel 65 in coplanar relationship therewith, and are adapted to extend through the shallow cut-outs 63 in the bottom edges of the side and end walls of the second member 52. An elongate support flap 67 extends upwardly from the outer edge of the stub 66 on one end of the bottom panel 65, and terminates at its upper end in an inwardly folded tab 68, which is adapted to be inserted inwardly through the opening 59 at the top edge of end wall 55 or end wall 56, depending upon which way the second member 52 is oriented, and into overlying relationship with the paper P contained within the box.

Similar flaps 69 and 70 are formed on opposite side edges of the bottom panel 65, and these flaps terminate at their upper ends in inwardly folded tabs 71, 72, respectively. The tabs 71 and 72 are adapted to extend through the openings 59 at the top edges of opposite side walls 53 and 54, and into overlying relationship with the stack of paper held within the box (See FIG. 14).

It will be noted that the length of the stubs 66 is substantially the same as the thickness of the wall panels of second member 52, whereby the flaps 67, 69 and 70 extend upwardly alongside the associated end and side panels in close, overlying relationship thereto. See FIG. 1 5. With reference to FIGS. 8–14, it will be noted that there is no flap extending upwardly along one end (56) of the box.

Figure 18:
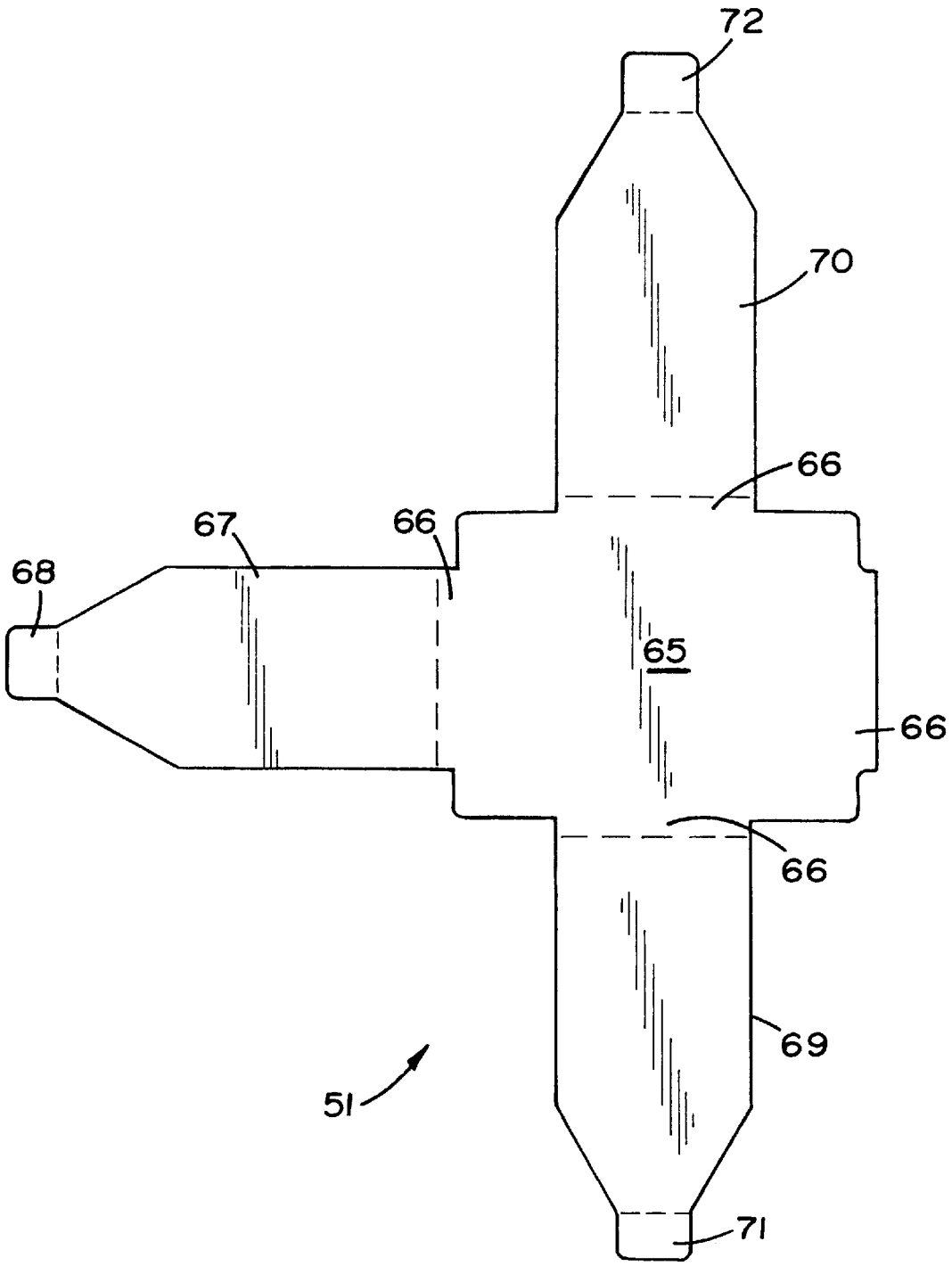
FIG. 18 is a top plan view of the blank used to form the first member used in making the package of FIG. 9.
Figure 19:
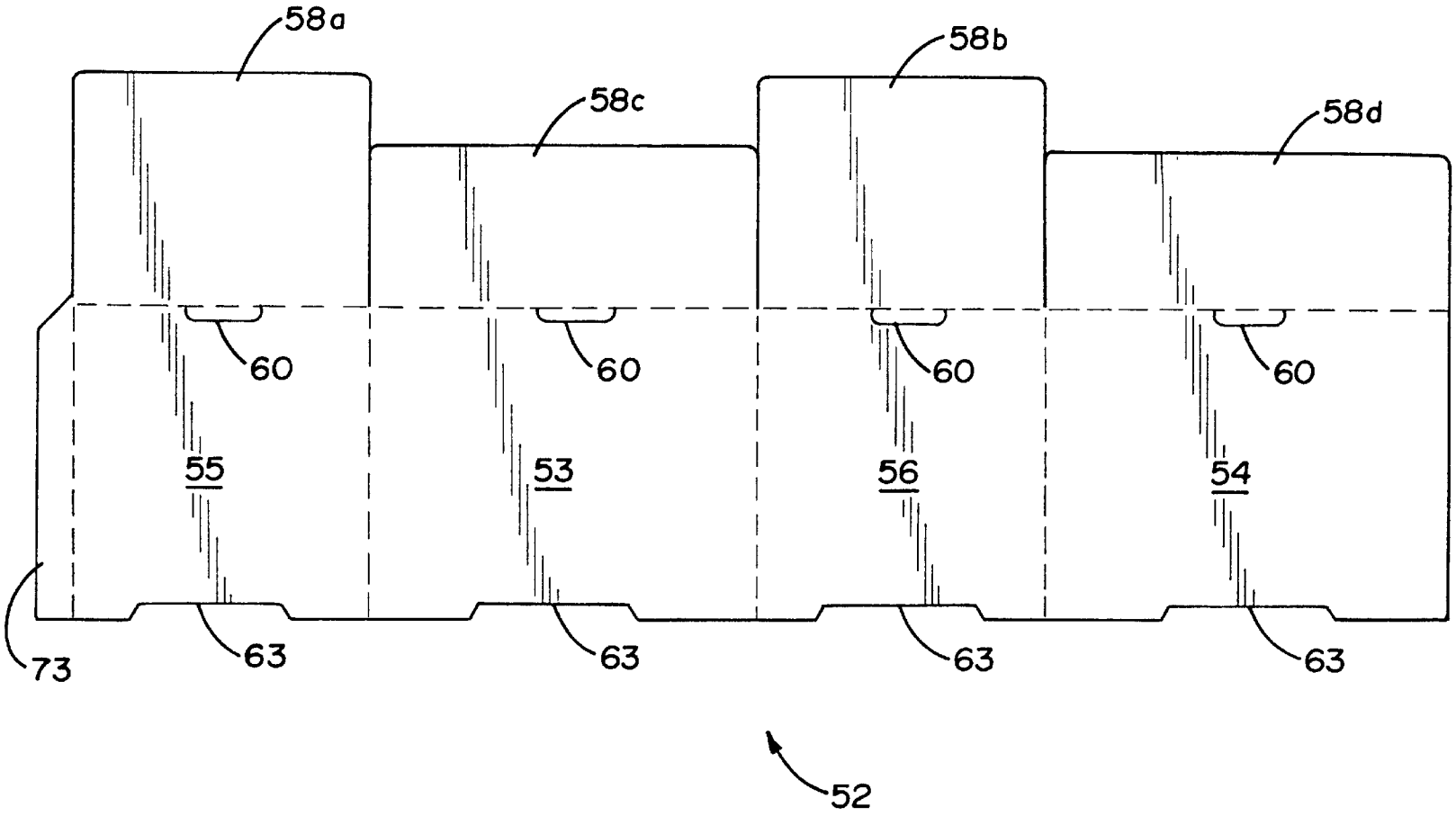
FIG. 19 is a top plan view of the blank used to form the second member used in making the package of FIG. 9.

The blanks from which the first and second members 51 and 52 are formed as shown, respectively, in FIGS. 18 and 19. With reference to FIG. 19, it will be seen that a narrow glue tab 73 is formed along one end edge of end panel 55 of second member 52.

In use of this form of the invention, the first and second members 51 and 52 are placed in operative relationship with one another, with the bottom panel 65 closing the open bottom of the second member 52, and the flaps 67, 69 and 70 on the first member 51 extending upwardly on the outside of an adjacent end wall and the opposite side walls of the second member. A stack of paper P is placed in the second member on top of the bottom panel 65, the closure flaps 58*a*–58*d* are folded inwardly into closing relationship over the top of the box, and the tabs 68, 71 and 72 are inserted inwardly through the openings 59 to hold the flaps 67, 69 and 70, and the associated bottom panel 65, in place.

The package may then be shrink-wrapped and may have a tie strap applied, if desired, for storage and handling.

Figure 12:
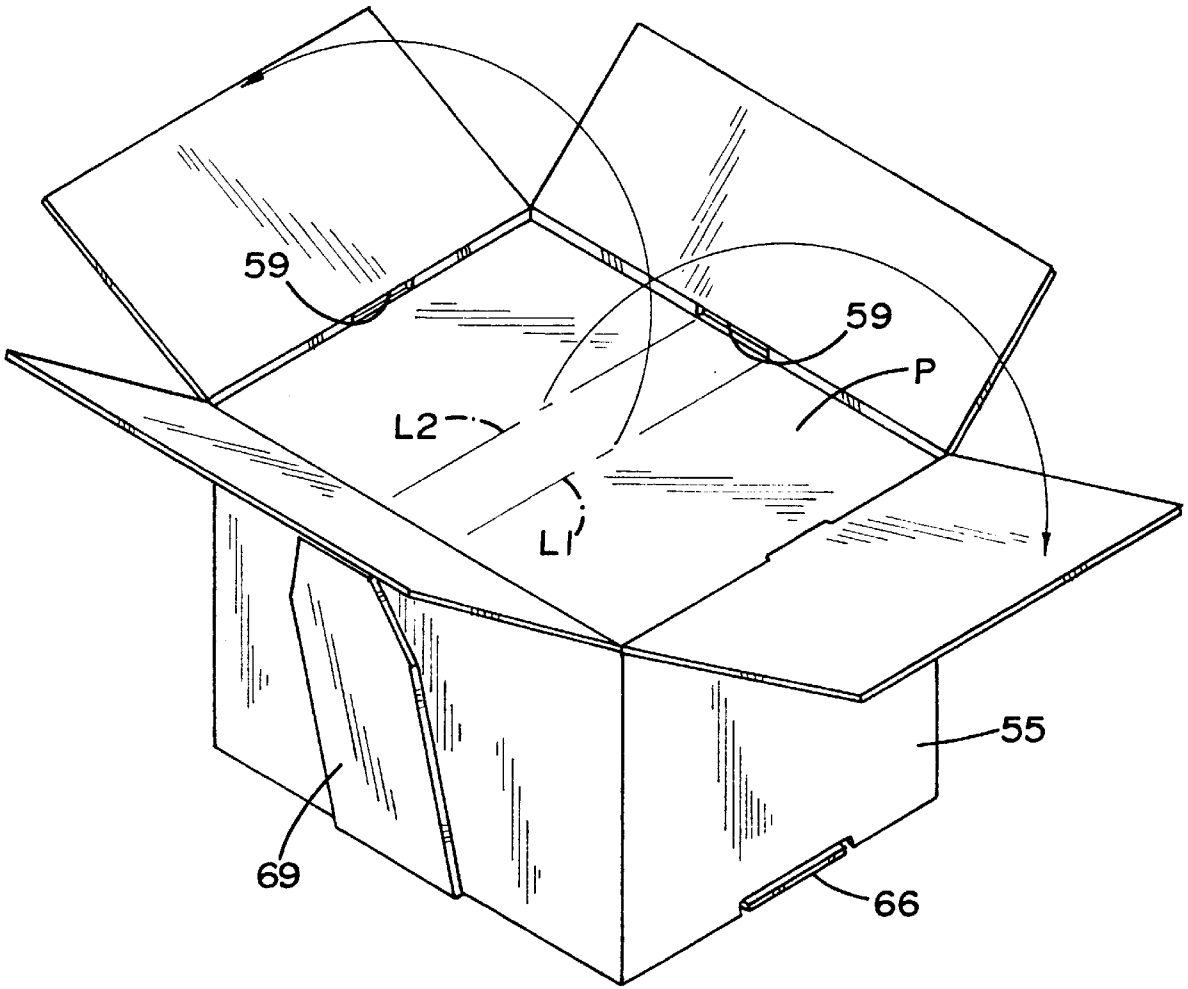
FIG. 12 is a top perspective view of the package of FIG. 10, showing all of the lid panels in opened position.

When it is desired to use the paper in the box, the shrink-wrap and tie strap, if used, are removed and the entire package is lifted into the paper supply bin of a photocopier or other machine and supported on the elevator platform E of the machine. Then, as illustrated in FIG. 10, the flaps 67, 69 and 70 are pulled outwardly to remove the tabs 68, 71 and 72 from their respective openings 59. Thereafter, the closure flaps 58*c* and 58*d* are opened as depicted in FIG. 11, followed by opening of the end closure flaps 58*a* and 58*b* as depicted in FIG. 12. The outer, box-like member 52 may then be lifted away from the stack of paper P, as depicted in FIG. 13, depositing the stack of paper and the bottom panel member 65 and its associated flaps on the elevator platform E. The machine may then access the paper from that end which is devoid of a flap, whereby the bottom panel member and its associated flaps may be left in place in the machine during use of the paper supported thereon.

It will thus be seen that the package according to either form of the invention provides a simple, economical and efficient means of storing and handling paper as well as depositing it onto the elevator platform of a photocopier or other machine. With either form of the invention, there is no need to directly handle the paper itself, and an entire box, typically five reams, may be deposited at one time into the paper supply bin. It will also be observed that the second member 52 is constructed so that it may be oriented in either direction in an end-to-end relationship for appropriate cooperation with the first member 51.

While particular embodiments of the invention have been illustrated and described in detail herein, it should be understood that various changes and modifications may be made to the invention without departing from the spirit and intent of the invention, as defined by the scope of the appended claims.

What is claimed is:

1. A method of depositing a stack of paper directly from a package into the paper supply bin of a machine which uses the paper in its operation, wherein the machine which uses the paper has a horizontal elevator platform on which the stack of paper is supported, comprising the steps of:

forming a package by placing a stack of cut sheets of paper within a box enclosure formed by placing two members in interconnected relationship in enclosing relationship around the stack of paper;

placing the package into the paper supply bin and onto the elevator platform of a machine which uses the paper;

sliding one of said interconnected members horizontally relative to the other to separate said members, and removing said one member from the paper supply bin; and lifting the other member vertically upwardly away from the stack of paper and out of the paper supply bin to deposit the stack of paper directly from the package into the paper supply bin and onto the elevator platform.

2. A method of depositing a stack of paper directly from a package into the paper supply bin of a machine which uses the paper, wherein the machine has a horizontal platform on which the paper is supported for use by the machine, comprising the steps of:

forming a package by placing two interengaged members around a stack of paper, defining a box enclosure enclosing the stack of paper;

placing the package, intact, into the paper supply bin of the machine, and onto said platform;

moving a first of said interconnected members horizontally relative to a second of said interconnected members to separate the first member from the package, and removing said first member from the paper supply bin; and moving the second member in a vertical direction to separate it from the stack of paper and remove it from the paper supply bin, to deposit the stack of paper directly from the package into the paper supply bin.

* * * * *